US006285140B1

(12) United States Patent
Ruxton

(10) Patent No.: US 6,285,140 B1
(45) Date of Patent: Sep. 4, 2001

(54) VARIABLE-EFFECT LIGHTING SYSTEM

(75) Inventor: James Ruxton, Toronto (CA)

(73) Assignee: Pharos Innovations Inc., Toronto (CA)

( * ) Notice: Subject to any disclaimer, the term of this patent is extended or adjusted under 35 U.S.C. 154(b) by 0 days.

(21) Appl. No.: 09/295,367

(22) Filed: Apr. 21, 1999

(51) Int. Cl.[7] ..... H05B 37/00

(52) U.S. Cl. ..... 315/312; 315/291; 315/309; 315/315

(58) Field of Search ..... 315/185 S, 193, 315/194, 195, 291, 307, 308, 305, 312, 315, 316, 324; 362/234

(56) References Cited

U.S. PATENT DOCUMENTS

| | | | |
|---|---|---|---|
| 1,809,181 | 6/1931 | Ramsden . | |
| 2,515,236 | 7/1950 | Kunins | 240/3.1 |
| 3,283,136 | 11/1966 | Dinkler et al. | 240/10 |
| 3,324,289 | 6/1967 | Cirko | 240/10.1 |
| 3,379,869 | 4/1968 | Dorman | 240/41.3 |
| 3,388,245 | 6/1968 | Larsen | 240/3.1 |
| 3,435,286 | 3/1969 | Kayatt | 315/47 |
| 3,789,211 | 1/1974 | Kramer | 240/10 R |
| 4,317,071 | 2/1982 | Murad | 315/312 |
| 4,866,580 | 9/1989 | Blackerby | 362/205 |
| 5,008,595 | 4/1991 | Kazar | 315/178 |
| 5,384,519 | 1/1995 | Gotoh | 315/324 |
| 5,420,482 | 5/1995 | Phares | 315/292 |
| 5,619,182 | 4/1997 | Robb | 340/479 |
| 5,629,587 * | 5/1997 | Gray et al. | 315/314 |
| 5,749,646 | 5/1998 | Brittell | 362/231 |
| 5,752,766 | 5/1998 | Bailey et al. | 362/250 |
| 5,924,784 * | 7/1999 | Chliwnyj et al. | 362/234 |

* cited by examiner

*Primary Examiner*—David Vu
*Assistant Examiner*—Thuy Vinh Tran
(74) *Attorney, Agent, or Firm*—Gowling Lafleur Henderson LLP

(57) ABSTRACT

A variable-effect lighting system includes a lamp assembly, and a programmable lamp controller. The lamp assembly comprises a string of bicolored lamps, each bicolored lamp including a first illuminating element for producing a first color of light, and a second illuminating element for producing a second color of light. The programmable lamp controller is coupled to the lamp assembly for setting the conduction angle of the illuminating elements according to at least one predetermined pattern stored in a memory of the lamp controller. Preferably, the controller includes a user-operable input to allow the user to select the predetermined pattern and hence the color display as desired.

21 Claims, 8 Drawing Sheets

VARIABLE-EFFECT LIGHTING SYSTEM

FIELD OF THE INVENTION

The present invention relates to variable-effect lighting systems. In particular, the present invention relates to a lighting system having coloured lamps for producing a myriad of colour displays.

BACKGROUND OF THE INVENTION

Variable-effect lighting systems are commonly used for advertising, decoration, and ornamental or festive displays. Such lighting systems frequently include a set of coloured lamps packaged in a common fixture, and a control system which controls the output intensity of each lamp in order to control the colour of light emanating from the fixture.

For instance, Kunins (U.S. Pat. No. 2,515,236) teaches a coloured light source comprising a fixture having a red lamp, a green lamp, and blue lamp, with each lamp being connected to separate output terminal of an autotransformer. The autotransformer is connected to an AC voltage source, and the core of the autotransformer is rotated by a motor so as to vary the voltage applied to each lamp and thereby control the colour of light emanating from the fixture. Although the light source taught by Kunins may be suitable for producing light of varying colour, the use of a motor and autotransformer is bulky and is not suitable for producing intricate colour displays.

More recently, multi-coloured light-emitting diodes (LEDs) have been used with electronic switches to improve the versatility of the lighting system. For instance, Kazar (U.S. Pat. No. 5,008,595) teaches a light display comprising strings of bicoloured LED packages connected in parallel across a common DC voltage source. Each bicoloured LED package comprises a pair of red and green LEDs, connected back-to-back, with the bicoloured LED packages in each string being connected in parallel to the voltage source through an H-bridge circuit. A control circuit, connected to the H-bridge circuits, allows the red and green LEDS to conduct each alternate half cycle, with the conduction angle each half cycle being determined according to a modulating input source coupled to the control circuit. As a result, the bicolour LEDS can be forced to illuminate continuously, or to flash. Further, the colour of light produced by each bicolour LED can be continuously varied between two extremes.

Although the light display taught by Kazar offers an improvement over prior variable-effect lighting systems, the control system and the H-bridge circuitry increases the complexity of the lighting system. Further, the rate of change of coloured light produced is restricted by the modulating input source. Therefore, the range of colour displays which can be produced by the light display is limited.

Phares (U.S. Pat. No. 5,420,482) teaches a controlled lighting system which allows a greater range of colour displays to be realized. The lighting system comprises a control system which transmits illumination data to a number of lighting modules. Each lighting module includes at least two lamps and a control unit connected to the lamps and responsive to the illumination data to individually vary the amount of light emitted from each lamp. However, the illumination data only controls the brightness of each lamp at any given instant. Therefore, the lighting system is not particularly well suited to easily producing intricate colour displays.

Murad (U.S. Pat. No. 4,317.071) teaches a computerized illumination system for producing a continuous variation in output colour. The illumination system comprises a number of different coloured lamps, a low frequency clock, and a control circuit connected to the low frequency clock and to each coloured lamp for varying the intensity of light produced by each lamp. However, the rate of change of lamp intensity is dictated by the frequency of the low frequency clock, and the range of colour displays is limited.

Accordingly, there remains a need for a relatively simple variable-effect lighting system which allows for greater variation in the range of colour displays which can be realized.

SUMMARY OF THE INVENTION

It is an object of the invention to provide a variable-effect lighting system which addresses the deficiencies of the prior art lighting systems.

The variable-effect lighting system, according to the invention, comprises a lamp assembly, and a programmable lamp controller. The lamp assembly includes a first illuminating element for producing a first colour of light, and a second illuminating element for producing a second colour of light. The programmable lamp controller is coupled to the lamp assembly for setting the conduction angle of the illuminating elements according to at least one predetermined pattern stored in a memory of the lamp controller. Preferably, the controller includes a user-operable input to allow the user to select the predetermined pattern and hence the colour display as desired. Alternately, the controller includes a temperature sensor for selecting the predetermined pattern according to ambient temperature, or a clock circuit for selecting the predetermined pattern according to the time.

In one embodiment of the invention, the programable lamp controller comprises a microcontroller for setting the conduction angle according to a plurality of user-selectable predetermined patterns. The lamp assembly comprises a string of series-connected bicoloured light-emitting diodes connected in series between an AC power source and an electronic switch. The electronic switch is coupled to an output of the microcontroller and sets the conduction angle of the illuminating elements of each bicoloured light-emitting diode according to the predetermined pattern selected.

In another embodiment of the invention, the lamp assembly comprises at least one bicoloured light-emitting diode coupled to a DC power source. The first illuminating element of the bicoloured light-emitting diode is coupled to the DC power source through a first electronic switch, and the second illuminating element of the bicoloured light-emitting diode is coupled to the DC power source through a second electronic switch. The electronic switches are each coupled to a respective output of the programmable controller for setting the conduction angles of the illuminating elements.

In yet another embodiment of the invention, the lamp assembly comprises at least one bicoloured light-emitting diode, with each illuminating element of the bicoloured light-emitting diode being driven directly by a respective output of the programmable controller.

Applications of the invention include Christmas tree light strings, temperature-sensitive lights, night lights, jewelry, key chains and decorative lighting displays.

BRIEF DESCRIPTION OF THE DRAWINGS

The preferred embodiments of the invention will now be described, by way of example only, with reference to the drawings, in which.

DETAILED DESCRIPTION OF THE PREFERRED EMBODIMENTS

Figure 1A:
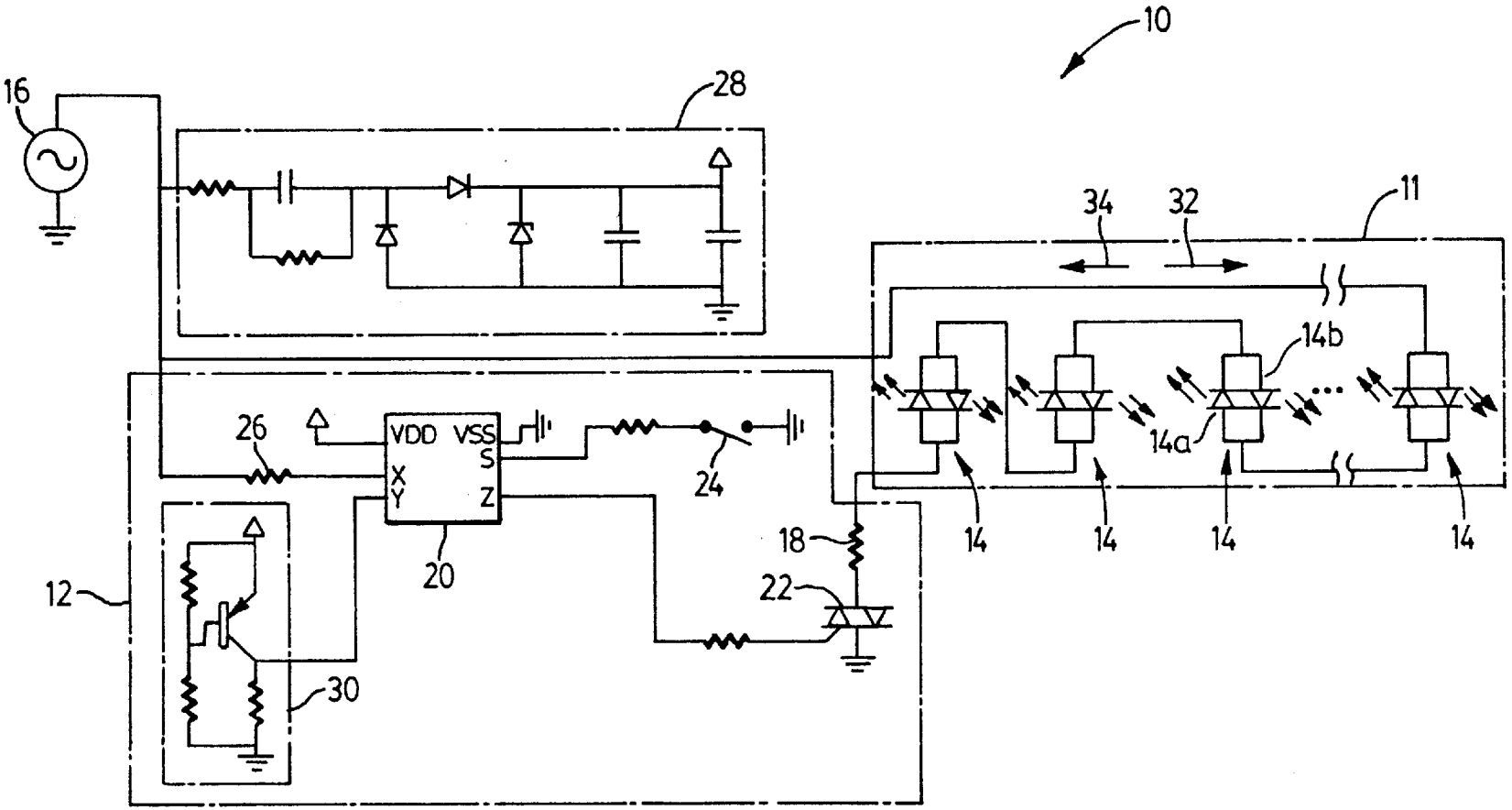
FIG. 1*a* is a schematic circuit diagram of a variable-effect lighting system according to a first embodiment of the invention, showing a programmable controller, and a lamp assembly comprising a string of series-coupled bicoloured lamps.

Turning to FIG. 1*a*, a variable-effect lighting system according to a first embodiment of the invention, denoted generally as 10, is shown comprising a lamp assembly 11, and a programmable lamp controller 12 coupled to the lamp assembly 11 for setting the colour of light produced by the lamp assembly 11. Preferably, the lamp assembly 11 comprises string of multi-coloured lamps 14 interconnected with flexible wire conductor to allow the ornamental lighting system 10 to be used as decorative Christmas tree lights. However, the multi-coloured lamps 14 may also be interconnected with substantially rigid wire conductor or affixed to a substantially rigid backing for applications requiring the lamp assembly 11 to have a measure of rigidity.

The multi-coloured lamps 14 are connected in series with each other and with an AC voltage source 16, and a current-limiting resistor 18. Typically the AC voltage source 16 comprises the 60 Hz 120 VAC source commonly available. However, other sources of AC voltage may be used without departing from the scope of the invention. As will be appreciated, the series arrangement of the lamps 14 eliminates the need for a step-down transformer between the AC voltage source 16 and the lamp assembly 11. The current-limiting resistor 18 limits the magnitude of current flowing through the lamps 14. However, the current-limiting resistor 18 may be eliminated if a sufficient number of lamps 14 are used, or if the magnitude of the voltage produced by the AC voltage source 16 is selected so that the lamps 14 will not be exposed to excessive current flow.

For longevity, each lamp 14 comprises a bicoloured LED having a first illuminating element for producing a first colour of light, and a second illuminating element for producing a second colour of light which is different from the first colour, and with the leads of each lamp 14 disposed such that when current flows through the lamp 14 in one direction the first colour of light is produced, and when current flows through the lamp 14 in the opposite direction the second colour of light is produced. As shown in FIG. 1*a*, preferably each bicoloured LED comprises a pair of differently-coloured LEDs 14*a*, 14*b* connected back-to-back, with the first illuminating element comprising the LED 14*a* and the second illuminating element comprising the LED 14*b*.

In a preferred implementation of the invention, the first illuminating element produces red light, and the second illuminating element produces green light. However, other LED colours may be used if desired. In addition, both LEDs 14*a*, 14*b* of some of the lamps 14 may be of the same colour if it is desired that some of the lamps 14 vary the intensity of their respective colour outputs only. Further, each lamp 14 may be fitted with a translucent ornamental bulb shaped as a star, or a flower or may have any other aesthetically pleasing shape for added versatility.

Figure 1B:
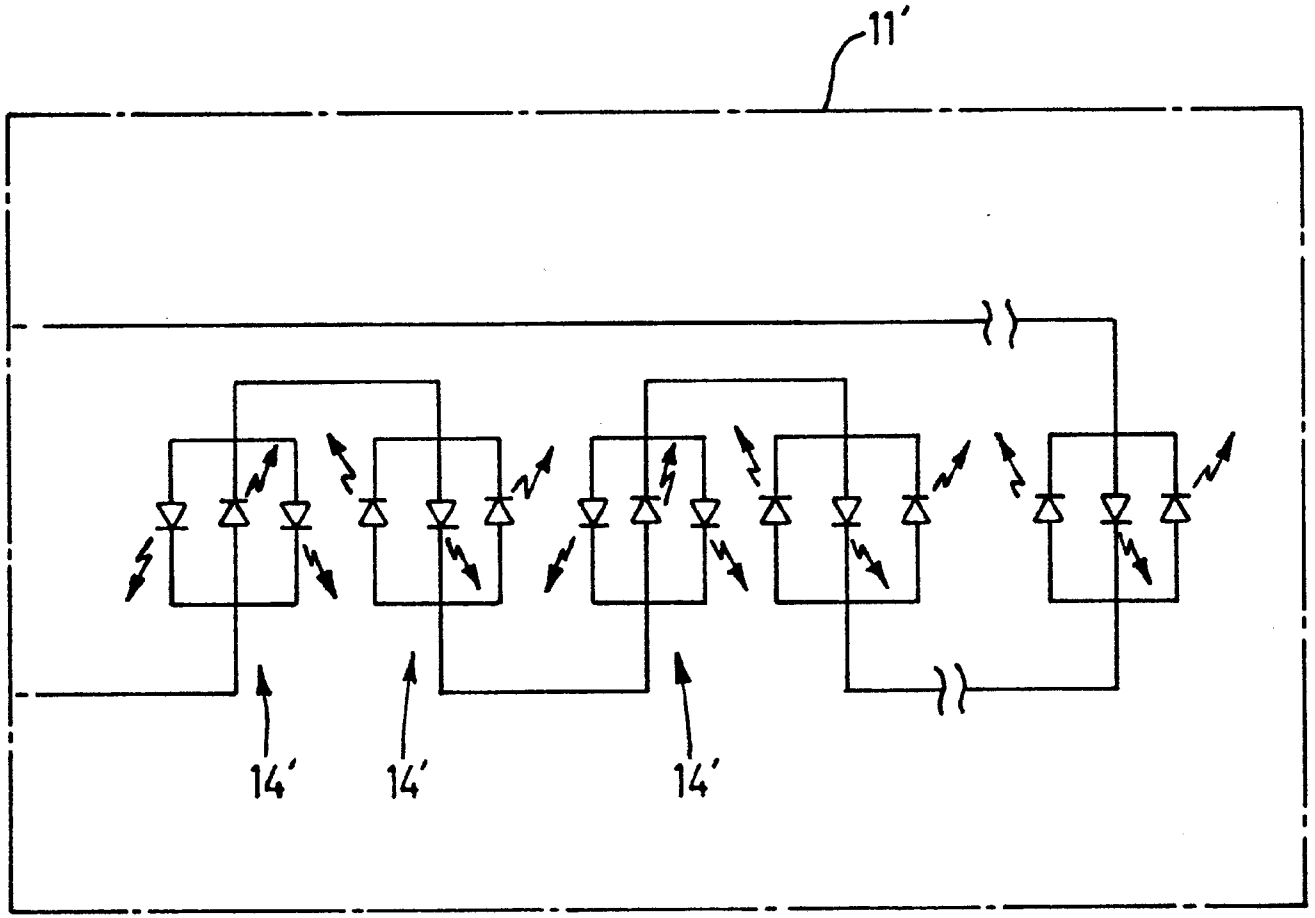
FIG. 1*b* is a schematic circuit diagram of one variation of the lamp assembly shown in FIG. 1*a;*

The programmable controller 12 comprises a microcontroller 20, a bidirectional semiconductor switch 22 controlled by an output Z of the microcontroller 20, and a user-operable switch 24 coupled to an input S of the microcontroller 20 for selecting the colour display desired. In addition, an input X of the microcontroller 20 is coupled to the AC voltage source 16 through a current-limiting resistor 26 for synchronization purposes, as will be described below. The bidirectional switch 22 is positioned in series with the lamps 14, between the current limiting resistor 18 and ground. In FIG. 1, the bidirectional switch 22 is shown comprising a triac switch. However, other bidirectional switches, such as IGBTs or back-to-back SCRs, may be used without departing from the scope of the invention.

The programmable controller 12 is powered by a 5-volt DC regulated power supply 28 connected to the AC voltage source 16 which ensures that the microcontroller 20 receives a steady voltage supply for proper operation. However, for added safety, the programmable controller 12 also includes a brownout detector 30 connected to an input Y of the microcontroller 20 for placing the microcontroller 20 in a stable operational mode should the supply voltage to the microcontroller 20 drop below acceptable limits.

The microcontroller 20 includes a non-volatile memory which is programmed or "burned-in" with preferably several conduction angle patterns for setting the conduction angle of the bidirectional switch 22 in accordance with the pattern selected. In this manner, the conduction angles of the LEDs 14*a*, 14*b* (and hence the colour display generated by the bicoloured lamps 14) can be selected.

Preferred colour displays include, but are not limited to:

1. continuous slow colour change between red, amber and green
2. continuous rapid colour change between red, amber and green
3. continuous alternate flashing of red and green
4. continuous random flashing of red and green
5. continuous illumination of red only
6. continuous change in intensity of red
7. continuous flashing of red only
8. continuous illumination of green only
9. continuous change in intensity of green
10. continuous flashing of green only
11. continuous illumination of red and green to produce amber
12. combination of any of the preceding colour displays However, as will be appreciated, the microcontroller 20 need only be programmed with a single conduction angle pattern to function. Further, the microcontroller 20 needs only to be programmed in situ with a user interface (not shown) for increased flexibility. As will be apparent, if the microcontroller 20 is programmed with only a single conduction angle pattern, the user-operable switch 24 may be eliminated from the programmable controller 12. Further, the user-operable switch 24 may be eliminated even when the microcontroller 20 is programmed with a number of conduction angle patterns, with the microcontroller 20 automatically switching between the various conduction angle patterns. Alternately, the user-operable switch 24 may be replaced with a clock circuit which signals the microcontroller 20 to switch conduction angle patterns according to the time.

The operation of the variable-effect lighting system 10 will now be described. Prior to power-up of the lighting system 10, the microcontroller 20 is programmed with at least one conduction angle pattern. Alternately, the microcontroller 20 is programmed after power-up using the above-described user interface. Once power is applied through the AC voltage source 16, the 5-volt DC regulated power supply 28 provides power to the microcontroller 20 and the brown-out detector 30.

After the brown-out detector 30 signals the microcontroller 20 at input Y that the voltage supplied by the power supply 28 has reached the threshold sufficient for proper operation of the microcontroller 20, the microcontroller 20 begins executing instructions for implementing a default conduction angle pattern. However, if a change of state is detected at the input S by reason of the user activating the user-operable switch 24, the microcontroller 20 will begin executing instructions for implementing the next conduction angle pattern. For instance, if the microcontroller 20 is executing instructions for implementing the third conduction angle pattern identified above, actuation of the user-operable switch 24 will force the microcontroller 20 to being executing instructions for implementing the fourth conduction angle pattern.

For ease of explanation, it is convenient to assume that the LED 14*a* is a red LED, and the LED 14*b* is a green LED. It is also convenient to assume that the first conduction angle pattern, identified above, is selected. The operation of the lighting system 10 for the remaining conduction angle patterns will be readily understood from the following description by those skilled in the art.

After the conduction angle pattern is selected, either by default or by reason of activation of the user-operable switch 24, the microcontroller 20 will begin monitoring the AC signal received at the input X to the microcontroller 20. Once a positive-going zero-crossing of the AC voltage source 16 is detected, the microcontroller 20 delays a predetermined period. After the predetermined period has elapsed, the microcontroller 20 issues a pulse to the bidirectional switch 22, causing the bidirectional switch 22 to conduct current in the direction denoted by the arrow 32. As a result, the red LED 14*a* illuminates until the next zero-crossing of the AC voltage source 16. In addition, while the LED 14*a* is conducting current, the predetermined period for the LED 14*a* is increased in preparation for the next positive-going zero-crossing of the AC voltage source 16.

After the negative-going zero-crossing of the AC signal source 16 is detected at the input X, the microcontroller 20 again delays a predetermined period. After the predetermined period has elapsed, the microcontroller 20 issues a pulse to the bidirectional switch 22, causing the bidirectional switch 22 to conduct current in the direction denoted by the arrow 34. As a result, the green LED 14*b* illuminates until the next zero-crossing of the AC voltage source 16. In addition, while the LED 14*b* is conducting current, the predetermined period for the LED 14*b* is decreased in preparation for the next negative-going zero-crossing of the AC voltage source 16.

With the above conduction angle sequence, it will be apparent that the period of time each cycle during which the red LED 14*a* illuminates will continually decrease, while the period of time each cycle during which the green LED 14*b* illuminates will continually increase. Therefore, the colour of light emanating from the bicoloured lamps 14 will gradually change from red, to amber, to green, with the colour of light emanating from the lamps 14 when both the LEDs 14*a*, 14*b* are conducting being determined by the instantaneous ratio of the magnitude of the conduction angle of the LED 14*a* to the magnitude of the conduction angle of the LED 14*b*.

When the conduction angle of the green LED 14*b* reaches 180°, the conduction angle pattern is reversed so that the colour of light emanating from the bicoloured lamps 14 changes from green, to amber and back to red. As will be appreciated, the maximum conduction angles for each conducting element of the lamps 14 can be set less than 180° if desired.

In a preferred implementation of the invention, the microcontroller 20 comprises a Microchip PIC12C508 microcontroller. The zero-crossings of the AC voltage source 16 are detected at pin 3, the state of the user-operable switch 24 is detected at pin 7, and the bidirectional switch 22 is controlled by pin 6. The brown-out detector 30 is coupled to pin 4. The assembly code listing for generating conduction angle patterns 1,2 and 3 with the Microchip PIC12C508 microcontroller is shown in Table A.

TABLE A

```
; Constants
    AC_IN EQU 4;        GP4 (pin 3) is AC input pin X
    TRIGGER_OUT EQU 1; GP1 (pin 6) is Triac Trigger pin Z
    BUTTON EQU 0; GP0 (pin 7) is Button 24 input pin S and is active low
    delay_dime EQU 0x007
    dim_val EQU 0x008
    trigger_delay EQU 0x009
    DELAY1 EQU 0x00A
    DELAY2 EQU 0x00B
    DELAY3 EQU 0x00C
    RED_INTENSITY EQU 0x00D
    SUBTRACT_REG EQU 0x00E
    DELAY5 EQU 0x00F
    FLASH_COUNT EQU 0x010
    FLASH_COUNT_SHAD EQU 0x011
```

TABLE A-continued

```
    FADE_DELAY EQU 0x012
    org 0;          RESET vector location
    movwf OSCCAL;   move data from W register to OSCCAL
    goto START
DELAY;          subroutine to delay 83 usec * register W
    movwf dim_val;
LOOP1
    movlw .27
    movwf delay_dim
LOOP2;          delay 83 usec
    decfsz delay_dim,1
    goto LOOP2
    decfsz dim_val,1
    goto LOOP1
return
TRIGGER;        subroutine to send trigger pulse to triac
    bsf GPIO,TRIGGER_OUT
            movlw b'00010001'
            TRIS GPIO;          send trigger to triac
    movlw .30
    movwf trigger_delay
LOOP3
    decfsz trigger_delay,1
    goto LOOP3;             delay 30 usec
            movlw b'00010011'
            TRIS GPIO;  remove trigger from triac
return
DELAY_SEC
    movlw .4
    movwf DELAY3;           set DELAY3
SEC2
    movlw .250
    movwf DELAY2;           set DELAY2
QUART_SEC2
    movlw .250
    movwf DELAY1;           set DELAY1
MSEC2
    clrwdt;     clear Watchdog timer
    decfsz DELAY1,1;        wait DELAY1
    goto MSEC2
    decfsz DELAY2,1;        wait DELAY2 * DELAY1
    goto QUART_SEC2
    decfsz DELAY3,1:        wait DELAY3 * DELAY2 * DELAY1
    goto SEC2
return
FADE_SUB;   subroutine to vary conduction angle for triac each half cycle
UP_LOOP;    increase delay before triac starts to conduct each negative half
            cycle while decreasing delay each positive half cycle
    btfss GPIO,AC_IN
    goto UP_LOOP;           wait for positive swing on AC input
WAIT_NEG1
    call WAIT_NEG_EDGE1;    increase delay before turning triac on each negative
                            half cycle
NO_CHANGE
    movlw .90;              register W = maximum delay value before triac turns on
    subwf RED_INTENSITY,0
    btfsc STATUS,Z
    goto WAIT_NEG2;         if RED_INTENSITY is equal to maximum delay value,
                            start increasing delay value
    movf RED_INTENSITY,0
    btfss GPIO,BUTTON
return;                     return if Button depressed
    call DELAY;             delay RED_INTENSITY * 83 usec
    call TRIGGER;           send trigger pulse to triac
MAIN_LOOP2
    btfsc GPIO,AC_IN
    goto MAIN_LOOP2; wait for negative swing on AC input
WAIT_POS_EDGE1
    btfss GPIO,AC_IN
    goto WAIT_POS_EDGE1;    wait for positive swing on AC input
    movlw .96
    movwf SUBTRACT_REG;         SUBTRACT_REG = maximum delay value
                                + minimum delay value before triac turns on
    movf RED_INTENSITY,0
    subwf SUBTRACT_REG,0
    call DELAY;             delay (SUBTRACT_RED-RED_INTENSITY) * 83 usec
    call TRIGGER;           send trigger pulse to triac
    goto UP_LOOP
DOWN_LOOP
```

TABLE A-continued

```
    btfss GPIO,AC_IN
    goto DOWN_LOOP; wait for positive swing on AC input
WAIT_NEG2
    call WAIT_NEG_EDGE2;      decrease delay before triac turns on each negative
                              half cycle
NO_CHANGE2
    movlw .6
    subwf RED_INTENSITY,0;    register W = RED_INTENSITY - minimum delay
                              value
    btfsc STATUS,Z
    goto WAIT_NEG1;           if RED_INTENSITY is equal to minimum delay
                              value, start increasing delay
    movf RED_INTENSITY,0
    btfss GPIO,BUTTON
return;                       return if Button depressed
    call DELAY;               delay RED_INTENSITY * 83 usec
    call TRIGGER;             send trigger pulse to triac
MAIN_LOOP3
    btfsc GPIO,AC_IN
    goto MAIN_LOOP3; wait for negative swing on AC input
WAIT_POS_EDGE2
    btfss GPIO,AC_IN
    goto WAIT_POS_EDGE2;      wait for positive swing on AC input
    movlw .96
    movwf SUBTRACT_REG;       SUBTRACT_REG = maximum delay value before
                              triac turns on
    movf RED_INTENSITY,0
    subwf SUBTRACT_REG,0
    call DELAY;               delay (SUBTRACT_REG-RED_INTENSITY) * 83 usec
    call TRIGGER;             send trigger pulse to triac
    goto DOWN_LOOP
return
WAIT_NEG_EDGE1;               routine to increase delay before triac turns on each negative
                              half cycle
    btfsc GPIO,AC_IN;         wait for negative swing on AC input
    goto WAIT_NEG_EDGE1
    decfsz DELAY5,1;          DELAY5 = fade delay, ie number of cycles at present delay
                              value; decrement and return if not zero
return
    incf RED_INTENSITY,1;     otherwise, increment delay and return
    movf FADE_DELAY,0
    movwf DELAY5
return
WAIT_NEG_EDGE2;               routine to decrease delay before triac turns on each negative
                              half cycle
    btfsc GPIO,AC_IN;         wait for negative swing on AC input
    goto WAIT_NEG_EDGE2
    decfsz DELAY5,1;          DELAY5 = number of cycles at present delay value;
                              decrement and return if not zero
return
    decf RED_INTENSITY,1;     otherwise decrement delay and return
    movf FADE_DELAY,0
    movwf DELAY5;             DELAY5 = FADE_DELAY
return
FLASH_SUB;                    subroutine to flash lights at speed dictated by value assigned to
                              FLASH_COUNT_SHAD
    movf FLASH_COUNT_SHAD,0
    movwf FLASH_COUNT;        FLASH_COUNT = duration of flash
MAIN_LOOP4
    btfsc CPIO,AC_IN;         wait for negative swing on AC input
    goto MAIN_LOOP4
WAIT_POS_EDGE4
    btfsc GPIO,AC_IN
    goto WAIT_POS_EDGE4;      wait for positive swing on AC input
    movlw .6
    call DELAY
    call TRIGGER;             send trigger pulse to triac
    btfss GPIO,BUTTON
return;                       return if Button pressed
    decfsz FLASH_COUNT
    goto MAIN_LOOP4;          decrement FLASH_COUNT and repeat until zero
    movf FLASH_COUNT_SHAD,0
    movwf FLASH_COUNT;        reset FLASH_COUNT
DOWN_LOOP4
    btfss GPIO,AC_IN;         wait for positive swing on AC input
    goto DOWN_LOOP4
WAIT_NEG_EDGE4
    btfsc GPIO,AC_IN
    goto WAIT_NEG_EDGE4;      wait for negative swing on AC input
```

TABLE A-continued

```
    movlw .6
    call DELAY
    call TRIGGER                send trigger pulse to triac
    btfss GPIO,BUTTON
return;                         return if Button pressed
    decfsz FLASH_COUNT
    goto DOWN_LOOP4;            decrement FLASH_COUNT and repeat until zero
return
START
    movlw b'00010011'
    TRIS GPIO;  set pins GP4 (AC input), GP1 (Triac output to high impedance),
                GP0 (Button as input)
    movlw b'10010111'; enable pullups on GP0, GP1, GP3
OPTION
    movlw .4
    movwf RED_INTENSITY;        load RED_INTENSITY register
    movlw .5
    movwf DELAY5;               set initial fade
FADE_SLOW
    call DELAY_SEC;             wait DELAY3 * DELAY2 * DELAY1
    movlw .5
    movwf FADE_DELAY;           set slow FADE_DELAY
    call FADE_SUB;              slowly fade colours until Button is pressed
    goto FADE_FAST
FADE_FAST
    call DELAY_SEC;             wait DELAY3 * DELAY2 * DELAY1
    movlw .1
    movwf FADE_DELAY;           set fast FADE_DELAY
    call FADE_SUB;              rapidly fade colours until Button is pressed
    goto FLASH2_SEC
FLASH2_SEC ; flash red/green 2 sec interval
    call DELAY_SEC;             wait DELAY3 * DELAY2 * DELAY1
    movlw .120
    movwf FLASH_COUNT_SHAD
FLASH2B_SEC
    btfss GPIO,BUTTON
    goto FLASH1_SEC;            slowly flash lights until Button is pressed
    call FLASH_SUB
    goto FLASH2B_SEC
FLASH1_SEC ; flash red/green 1 sec. interval
    call DELAY_SEC;             wait DELAY3 * DELAY2 * DELAY1
    movlw .60
    movwf FLASH_COUNT_SHAD
FLASH1B_SEC
    btfss GPIO,BUTTON
    goto FLASH_FAST;            flash lights at moderate speed until Button in pressed
    call FLASH_SUB
    goto FLASH1B_SEC
FLASH_FAST ; flash red/green 0.25 sec. interval
    call DELAY_SEC;             wait DELAY3 * DELAY2 * DELAY1
    movlw .15
    movwf FLASH_COUNT_SHAD
FLASH_FASTB
    btfss GPIO,BUTTON
    goto FADE_SLOW;             rapidly flash lights until Button is pressed
    call FLASH_SUB;             slowly fade colours if Button is pressed
    goto FLASH_FASTB
end
```

Numerous variations of the lighting system 10 are possible. In one variation (not shown), the user-operable switch 24 is replaced with a temperature sensor coupled to the input S of the microcontroller 20 for varying the conduction angle pattern according to the ambient temperature. Alternately, the programmable lamp controller 12 includes a plurality of temperature sensors, each being sensitive to a different temperature range, and being coupled to a respective input of the microcontroller 20. With these variations, one colour display is produced when the ambient temperature falls within one range and another colour display is produced when the ambient temperature falls within a different range.

In another variation (not shown), each lamp 14 comprises a pair of LEDs with one of the LEDs being capable of emitting white light and with the other of the LEDs being capable of producing a colour of light other than white. In still another variation, each lamp 14 comprises a LED capable of producing three or more different colours of light, while in the variation shown in FIG. 1*b*, each lamp 14 comprises three or more differently-coloured LEDs. In these latter two variations, the LEDs are connected such that when current flows in one direction one colour of light is produced, and when current flows in the opposite direction another colour of light is produced.

Figure 1C:
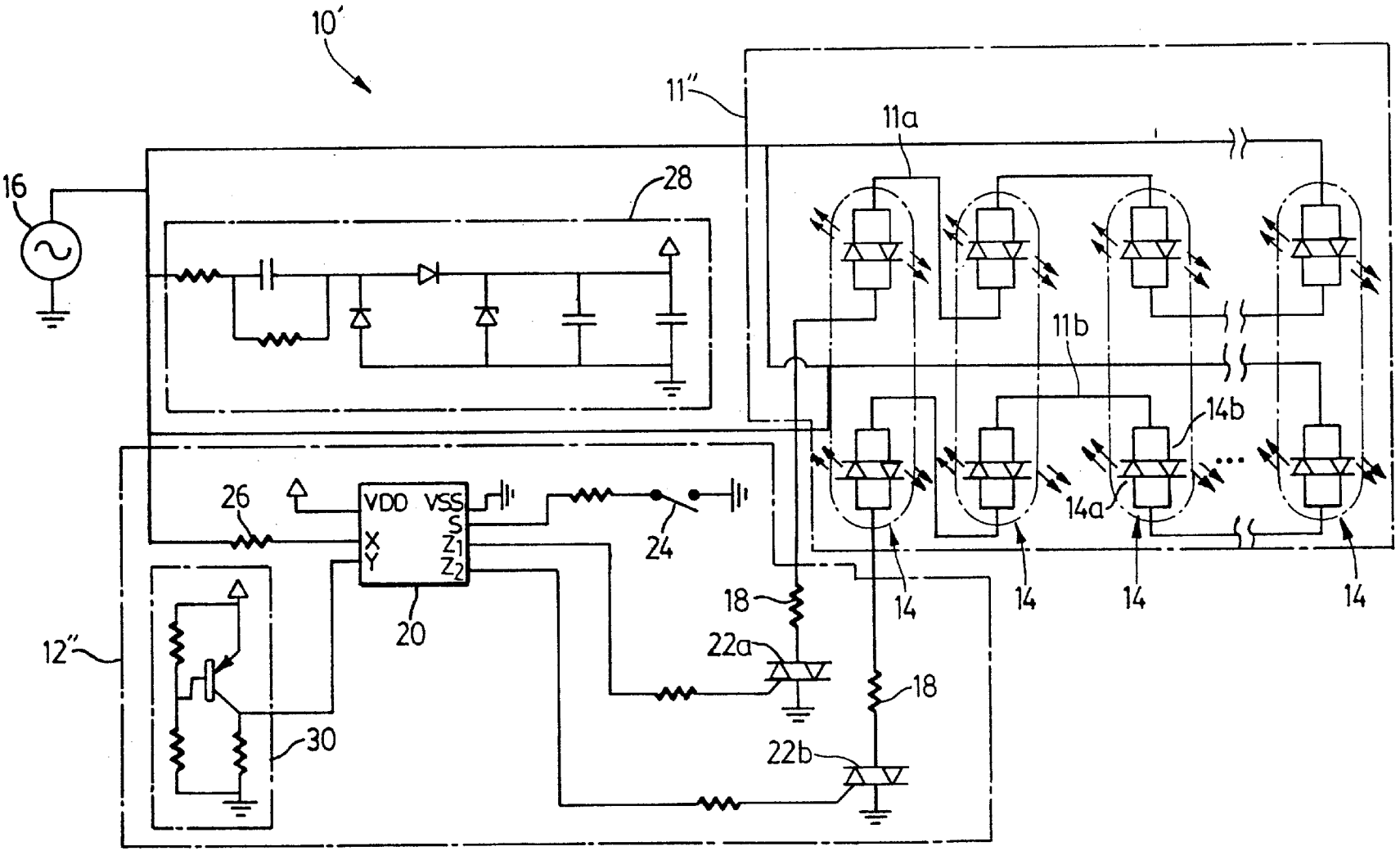
FIG. 1*c* is a schematic circuit diagram of another variation of the lamp assembly shown in FIG. 1*a;*

In yet another variation, shown in FIG. 1*c*, the programmable lamp controller 12 comprises two bidirectional switches 22*a*, 22*b* each connected to a respective output 21, Z2 of the microcontroller 20. The lamp assembly 11 comprises first and second strings 11*a*, 11*b* of series-connected back-to-back-coupled LEDs 14*a*, 14*b*, with each string 11*a*, 11*b* being connected to the AC voltage source 16 and to a respective one of the bidirectional switches 22*a*, 22*b*. In this variation, each multi-coloured lamp 14 comprises one pair of the back-to-back-coupled LEDs 14*a*, 14*b* of the first string 11*a* and one pair of the back-to-back-coupled LEDs 14*a*, 14*b* of the second string 11*b*, with the LEDs of each lamp 14 being inserted in a respective translucent ornamental bulb. As a result, the colour of light emanating from each bulb depends on the instantaneous ratio of the conduction angles of the LEDs 14*a*, 14*b* in both strings 11*a*, 11*b*. Preferably, the outputs Z1, Z2 are independently operable to increase the range of colour displays.

Figure 2A:
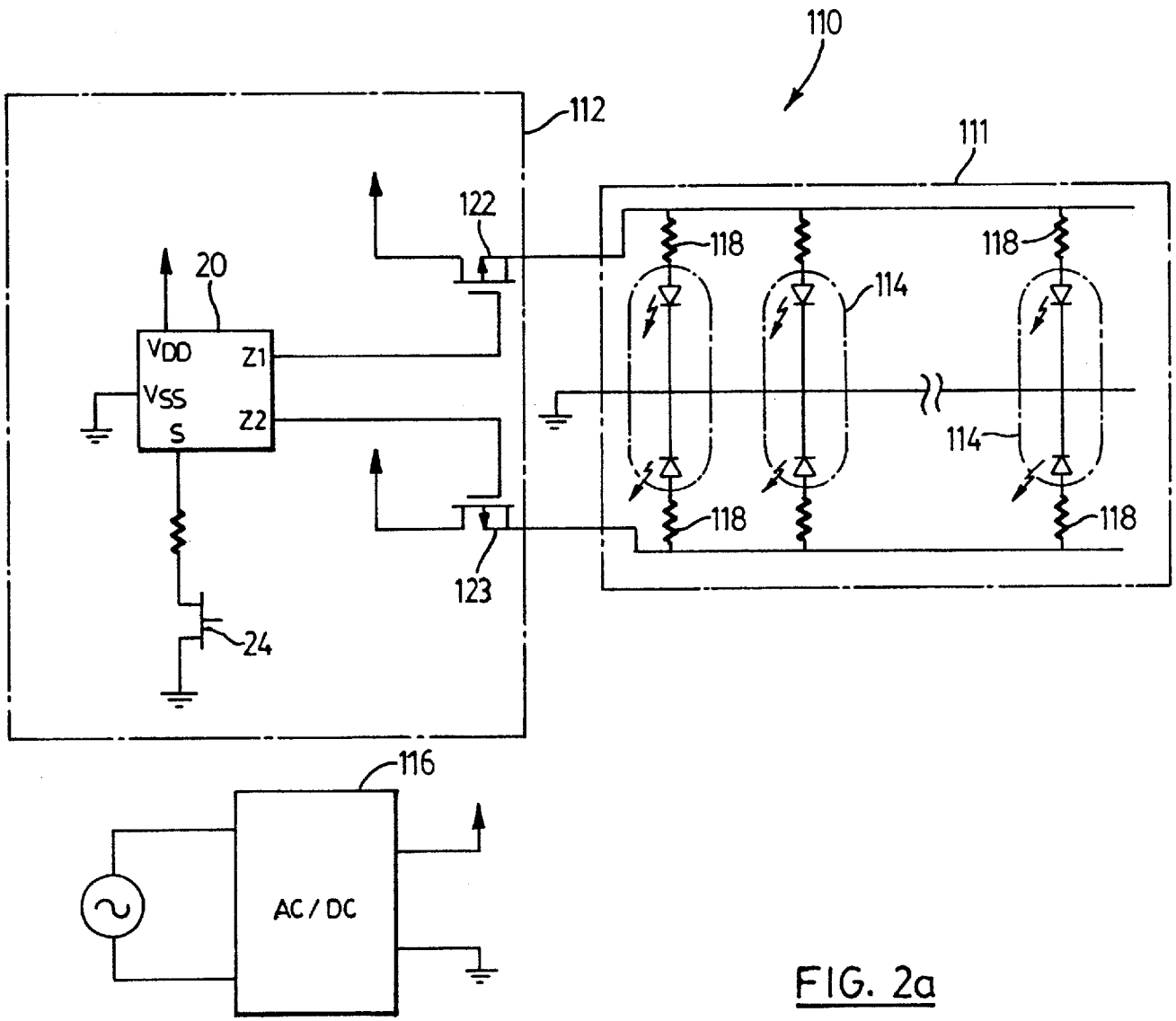
FIG. 2*a* is a schematic circuit diagram of a variable-effect lighting system according to a second embodiment of the invention, wherein the lamp assembly comprises a string of parallel-coupled bicoloured lamps.

In a further variation, the programmable lamp controller 12 is similar to the programmable lamp controller 12 shown in FIG. 1*c*, in that it comprises two bidirectional switches 22*a*, 22*b* each connected to a respective independently-operable output Z1, Z2 of the microcontroller 20. However, unlike the programmable lamp controller 12 shown in FIG. 1*c*, the lamp assembly 11 comprises first and second strings 11*a*, 11*b* of series-connected singly-coloured lamps 14. As above, each singly-coloured lamp 14 of the first string 11*a* is associated with a singly-coloured lamp 14 of the second string 11*b*, with each associated lamp pair being inserted in a respective translucent ornamental bulb. Turning to FIG. 2*a*, a variable-effect lighting system according to a second embodiment of the invention, denoted generally as 110, is shown comprising a lamp assembly 111, and a programmable lamp controller 112 coupled to the lamp assembly 111 for setting the colour of light produced by the lamp assembly 111.

The lamp assembly 111 comprises a string of multi-coloured lamps 114 connected in parallel with each other. The multi-coloured lamps 114 are also connected in parallel with an AC/DC converter 116 which is coupled to an AC voltage source. Each lamp 114 comprises a bicoloured LED having a first illuminating element for producing a first colour of light, and a second illuminating element for producing a second colour of light which is different from the first colour, with the leads of each lamp 114 configured such that when current flows through one lead the first colour of light is produced, and when current flows through the another lead the second colour of light is produced. As shown in FIG. 2*a*, preferably each bicoloured LED comprises first and second differently-coloured LEDs 114*a*, 114*b* in series with a respective current-limiting resistor 118, with the common cathode of the LEDs 114 being connected to ground, and with the first illuminating element comprising the first LED 114*a* and the second illuminating element comprising the second LED 114*b*.

The AC/DC converter 116 produces a DC output voltage of a magnitude which is sufficient to power the lamps 114, but which will not damage the lamps 114. Typically, the AC/DC converter 116 receives 120 volts AC at its input and produces an output voltage of about 5 volts DC.

The programmable controller 112 is also powered by the output of the AC/DC converter 116 and comprises a microcontroller 20, a first semiconductor switch 122 controlled by an output Z1 of the microcontroller 20, a second semiconductor switch 123 controlled by an output Z2 of the microcontroller 20, and a user-operable switch 24 coupled to an input S of the microcontroller 20 for selecting the colour display desired. As discussed above, the user-operable switch 24 may be eliminated if desired. In FIG. 2*a*, the semiconductor switches 122, 123 are shown comprising MOSFET switches. However, other semiconductor switches may be used without departing from the scope of the invention.

The first semiconductor switch 122 is connected between the output of the AC/DC converter 116 and the anode of the first LED 114*a* (through the first current-limiting resistor 118), while the second semiconductor switch 123 is connected between the output of the AC/DC converter 116 and the anode of the second LED 114*b* (through the second current-limiting resistor 118). However, the anodes of the LEDs 114*a*, 114*b* may be coupled instead to the output of the AC/DC converter, with the first and second semiconductor switches 122, 123 being connected between the respective cathodes and ground. Other variations on the placement of the semiconductor switches 122, 123 will be apparent to those skilled in the art.

As with the previously described embodiment, the microcontroller 20 includes a non-volatile memory which is programmed with preferably several conduction angle sequences for setting the firing angle of the semiconductor switches 122, 123 in accordance with the sequence selected. In this manner, the conduction angles of the LEDs 114*a*, 114*b*, and hence the ultimate colour display generated by the lamps 114 can be selected.

The operation of the variable-effect lighting system 110 is similar to the operation of the variable-effect lighting system 10. After power is applied to the AC/DC converter 116, the microcontroller 20 begins executing instructions for implementing one of the conduction angle sequences. Again, assuming that the first conduction angle sequence, identified above, is selected, the microcontroller 20 issues a signal to the first semiconductor switch 122, causing the first LED 114*a* to illuminate. After a predetermined period has elapsed, the signal to the first semiconductor switch 122 is removed, causing the first LED 114*a* to extinguish. While the LED 114*a* is conducting current, the predetermined period for the first LED 114*a* is decreased in preparation for the next cycle.

The microcontroller 20 then issues a signal to the second semiconductor switch 123, causing the second LED 114*b* to illuminate. After a predetermined period has elapsed, the signal to the second semiconductor switch 123 is removed, causing the second LED 114*b* to extinguish. While the second LED 114*b* is conducting current, the predetermined period for the second LED 114*b* is increased in preparation for the next cycle.

With the above conduction angle sequence, it will be apparent that the period of time each cycle during which the first LED 114*a* illuminates will continually decrease, while the period of time each cycle during which the second LED 114*b* illuminates will continually increase. Therefore, the colour of light emanating from the lamps 114 will gradually change from the colour of the first LED 114*a* to the colour of the second LED 114*b*, with the colour of light emanating from the lamps 114 when both the LEDs 114*a*, 114*b* are conducting being determined by the instantaneous ratio of the magnitude of the conduction period of the first LED 114*a* to the magnitude of the conduction period of the second LED 114*b*.

Figure 2B:
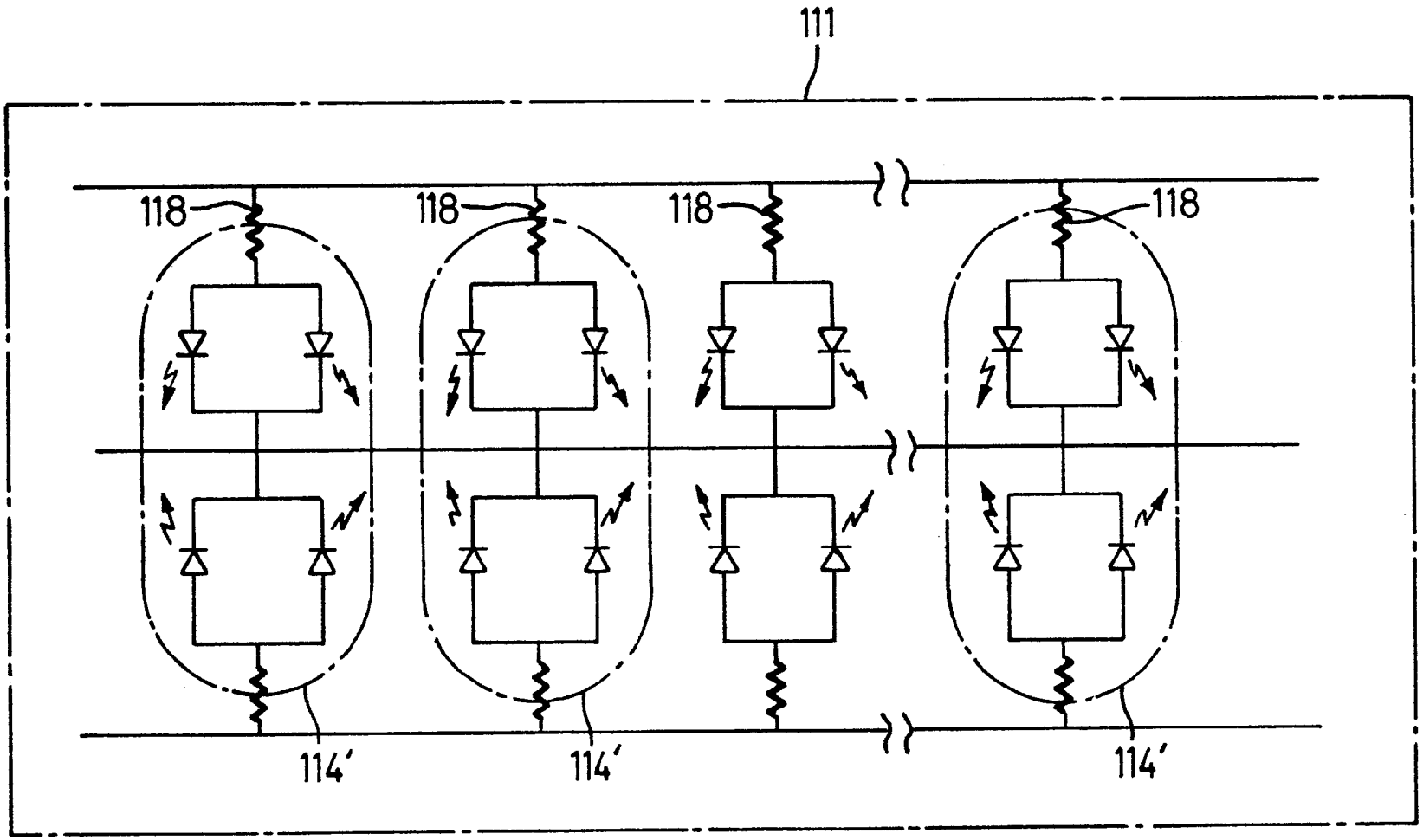
FIG. 2*b* is a schematic circuit diagram of one variation of the lamp assembly shown in FIG. 2*a;*
Figure 2C:
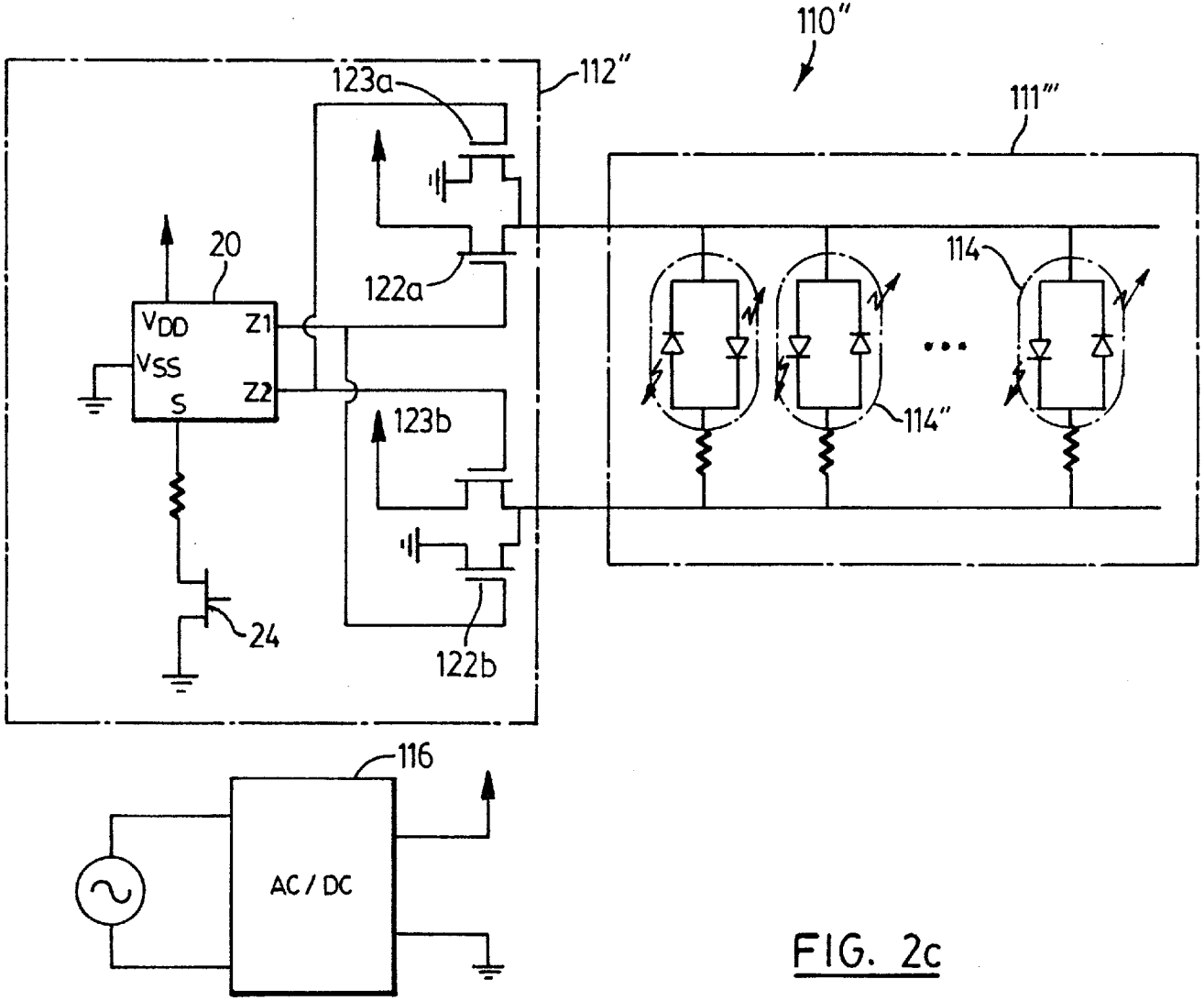
FIG. 2*c* is a schematic circuit diagram of one variation of the variable-effect lighting system shown in FIG. 2*a;*

Numerous variations of the lighting system 110 are also possible. In one variation, each lamp 114 comprises a pair of LEDs with one of the LEDs being capable of emitting white light and with the other of the LEDs being capable of producing a colour of light other than white. In another variation, each lamp 114 comprises a LED capable of producing three or more different colours of light, while in the variation shown in FIG. 2*b*, each lamp 114 comprises three or more differently-coloured LEDs. In these latter two variations, the LEDs are connected such that when current flows through one of the semiconductor switches one colour of light is produced, and when current flows through the other of the semiconductor switches another colour of light is produced. In yet another variation, shown in FIG. 2*c*, the programmable controller 112 includes a first pair of electronic switches 122*a*, 122*b* driven by the output Z1 of the microcontroller 20, and a second pair of electronic switches 123*a*, 123*b* driven by the output Z1 of the microcontroller 20. Each pair of first and second LEDs 114*a*, 114*b* of each lamp 114 are connected back-to-back, such that the lamps 114 and the semiconductor switches 122, 123 are configured together as an H-bridge. As discussed above, preferably the first and second LEDs 114*a*, 114*b* produce different colours, although the invention is not intended to be so limited.

Figure 3:
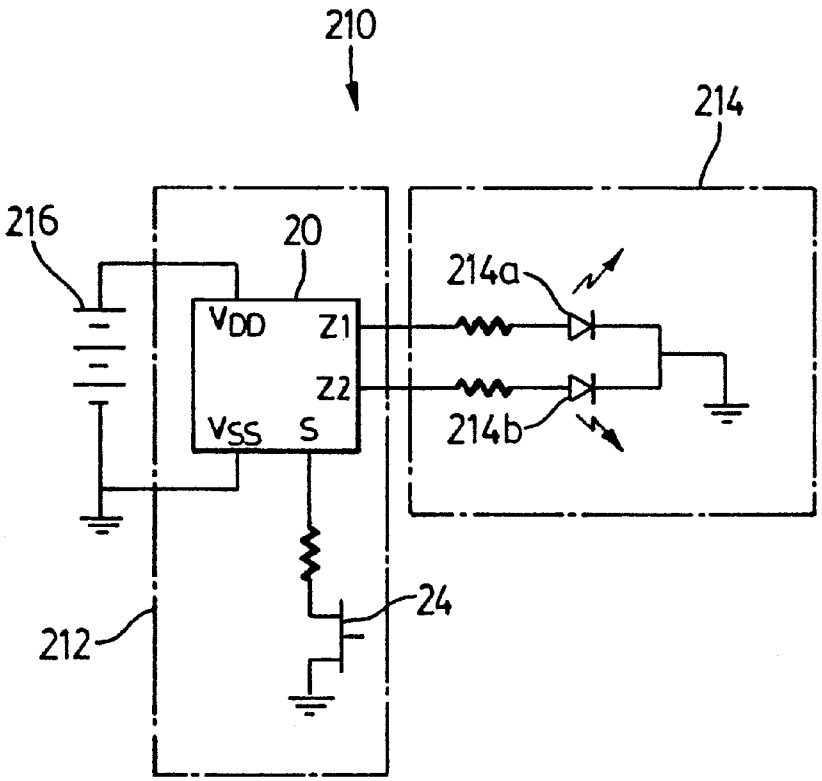
FIG. 3 is a schematic circuit diagram of a variable-effect lighting system according to a third embodiment of the invention, wherein the programmable controller directly drives each bicoloured lamp.

Turning to FIG. 3, a variable-effect lighting system according to a third embodiment of the invention, denoted generally as 210, is shown comprising a multi-coloured lamp 214, and a programmable lamp controller 212 coupled to the multi-coloured lamp 214 for setting the colour of light produced by the lamp 214. The multi-coloured lamp 114 comprises a bicoloured LED having a first illuminating element for producing a first colour of light, and a second illuminating element for producing a second colour of light which is different from the first colour. As shown in FIG. 3, preferably the first illuminating element comprises a red-coloured LED 214*a*, and the second illuminating element comprises a green-coloured LED 214*b*, with the common cathode of the LEDs 214*a*, 214*b* being connected to ground. As discussed above, multi-coloured LEDs and/or arrangements of differently-coloured discrete LEDs and/or translucent ornamental bulbs may be used if desired.

The programmable controller 212 is powered by a 9-volt battery 216, and comprises a microcontroller 20, and a user-operable switch 24 coupled to an input S of the microcontroller 20 for selecting the colour display desired. Alternately, for applications where space is at a premium, the programmable controller 212 may be powered by a smaller battery producing a smaller voltage. If necessary, the smaller battery may be coupled to the programmable controller 212 through a voltage amplifier, such as a DC-to-DC converter. As discussed above, the user-operable switch 24 may also be eliminated if desired.

An output Z1 of the microcontroller 20 is connected to the anode of the red LED 214*a*, and an output Z2 of the microcontroller 20 is connected to the anode of the green LED 214*b*. Since the lamp 214 is driven directly by the microcontroller 20, the variable-colour ornamental lighting system 210 is limited to applications requiring only a small number of lamps 214.

The operation of the variable-effect lighting system 210 will be readily apparent from the foregoing discussion and, therefore, need not be described.

Figure 4:
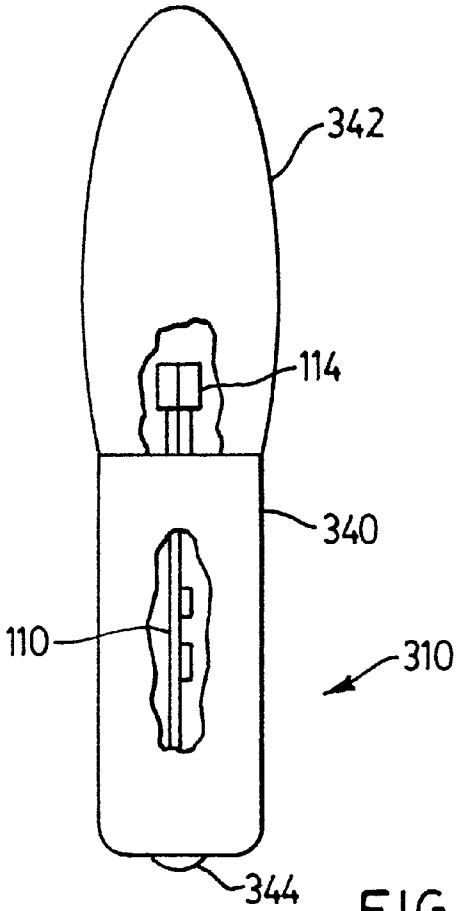
FIG. 4 is a night light according to one implementation of the embodiment shown in FIG. 2.

Turning now to FIG. 4, a night light 310 is shown comprising the variable-effect lighting system 110, described above, but including only a single multi-coloured lamp 114, a housing 340 enclosing the programmable controller 112 and the AC/DC converter 116, and a translucent bulb 342 covering the lamp 114 and fastened to the housing 340. Preferably, the housing 340 also includes an ambient light sensor 344 connected to the microcontroller 20 for inhibiting conduction of the lamp 114 when the intensity of ambient light exceeds a threshold.

Figure 5B:
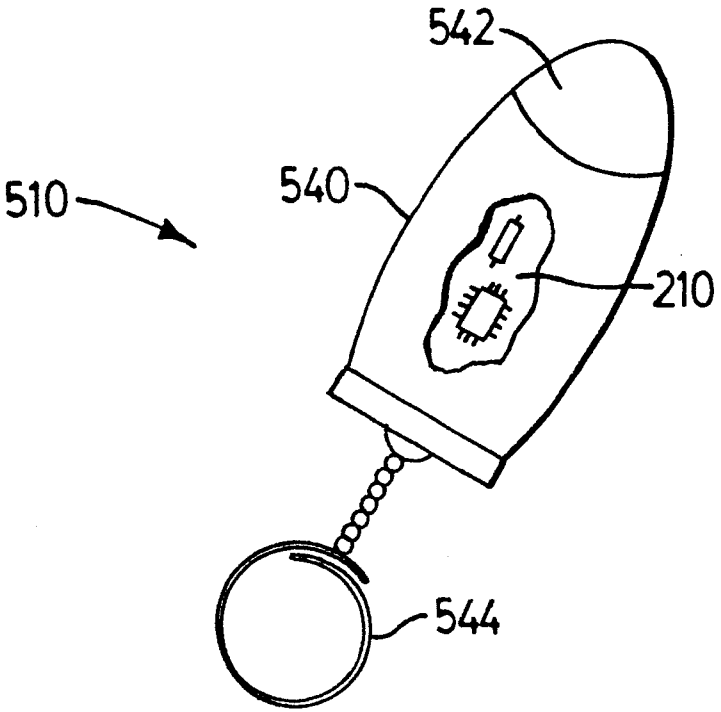
FIG. 5*b* is a key chain according to another implementation of the embodiment shown in FIG. 3.
Figure 5A:
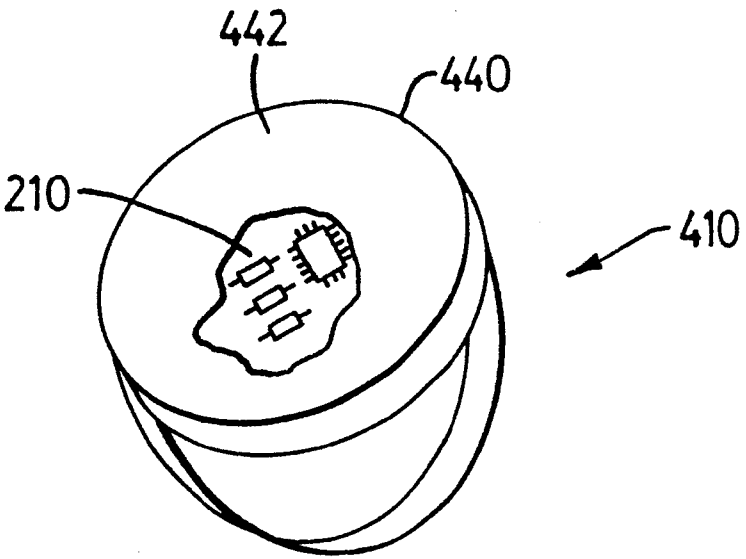
FIG. 5*a* is a jewelry piece according to one implementation of the embodiment shown in FIG. 3.

In FIG. 5*a*, a jewelry piece 410, shaped as a ring, is shown comprising the variable-effect lighting system 210, described above, and a housing 440 retaining the lamp 214, the programmable controller 212, and the battery 216 therein. A portion 442 of the housing 440 is translucent to allow light to be emitted from the lamp 214. In FIG. 5*a*, a key chain 510, is shown comprising the variable-colour ornamental lighting system 210, and a housing 540 retaining the lamp 214, the programmable controller 212, and the battery 216 therein. A portion 542 of the housing 540 is translucent to allow light to be emitted from the lamp 214. A key clasp 544 is coupled to the housing 540 to retain keys. Both the jewelry piece 410 and the key chain 510 may optionally include a user-operable input for selecting the conduction angle pattern.

The foregoing description of the preferred embodiments is intended to be illustrative of the present invention. Those of ordinary skill will be able to envision certain additions, deletions and/or modifications to the described embodiments without departing from the spirit or scope of the invention as defined by the appended claims.

I claim:

1. A variable-effect lighting system comprising:

a lamp assembly comprising a plurality of multi-coloured lamps in parallel with a DC voltage source, each said multi-coloured lamp comprising a first illuminating element for producing a first colour of light, and a second illuminating element for producing a second colour of light different from the first colour; and a programmable lamp controller coupled to the lamp assembly for setting a conduction angle of each said illuminating element according to at least one predetermined pattern, each said predetermined pattern being stored in a memory of the controller, the lamp controller including a first electronic switch coupled to the first illuminating element and a second electronic switch coupled to the second illuminating element.

2. The lighting system according to claim 1, wherein the at least one pattern is selectable according to a user-operable input to the controller.

3. The lighting system according to claim 1, wherein the lamp controller includes a temperature sensor for selecting the at least one pattern.

4. The lighting system according to claim 1, wherein each said multi-coloured lamp comprises a pair of commonly-coupled light-emitting diodes, a first light-emitting diode of the light-emitting diode comprising the first illuminating element and a second light-emitting diode of the light-emitting diode pair comprising the second illuminating element.

5. The lighting system according to claim 4, wherein the first and second electronic switches form an H-bridge.

6. A night light comprising:

a lamp assembly comprising at least one multi-coloured lamp in parallel with a DC voltage source, each said multi-coloured lamp comprising a first illuminating element for producing a first colour of light, and a second illuminating element for producing a second colour of light different from the first colour;

a programmable lamp controller coupled to the lamp assembly for setting a conduction angle of each said illuminating element according to at least one predetermined pattern, each said predetermined pattern being stored in a memory of the controller, the lamp controller including a first electronic switch coupled to the first illuminating element and a second electronic switch coupled to the second illuminating element; and an AC/DC converter providing the DC voltage source.

7. The night light according to claim 6, wherein each said predetermined pattern is selectable according to a user-operable input to the controller.

8. The night light according to claim 6, wherein each said multi-coloured lamp comprises a pair of commonly-coupled light-emitting diodes, a first light-emitting diode of the light-emitting diode comprising the first illuminating element and a second light-emitting diode of the light-emitting diode pair comprising the second illuminating element.

9. The night light according to claim 6, wherein the controller includes an ambient light sensor for inhibiting conduction of the illuminating elements when an intensity of ambient light exceeds a threshold.

10. A jewelry piece comprising:

a lamp assembly comprising at least one multi-coloured lamp in parallel with a DC voltage source, each said multi-coloured lamp comprising a first illuminating element for producing a first colour of light, and a second illuminating element for producing a second colour of light different from the first colour;

a programmable lamp controller coupled to the lamp assembly for setting a conduction angle of each said illuminating element according to at least one predetermined pattern, each said predetermined pattern being stored in a memory of the controller, the lamp controller including a first electronic switch coupled to the first illuminating element and a second electronic switch coupled to the second illuminating element; and a DC power source for powering the lamp assembly and the controller.

11. The jewelry piece according to claim 10, wherein each said predetermined pattern is selectable according to a user-operable input to the controller.

12. The jewelry piece according to claim 10, wherein the lamp controller includes a temperature sensor for selecting the at least one pattern.

13. The jewelry piece according to claim 10, wherein each said multi-coloured lamp comprises a pair of commonly-coupled light-emitting diodes, a first light-emitting diode of the light-emitting diode comprising the first illuminating element and a second light-emitting diode of the light-emitting diode pair comprising the second illuminating element.

14. A key chain comprising:

a lamp assembly comprising at least one multi-coloured lamp in parallel with a DC voltage source, each said multi-coloured lamp comprising a first illuminating element for producing a first colour of light, and a second illuminating element for producing a second colour of light different from the first colour;

a programmable lamp controller coupled to the lamp assembly for setting a conduction angle of each said illuminating element according to at least one predetermined pattern, each said predetermined pattern being stored in a memory of the controller, the lamp controller including a first electronic switch coupled to the first illuminating element and a second electronic switch coupled to the second illuminating element;

a DC power source for powering the lamp assembly and the controller;

a housing retaining the lamp assembly, the controller and the power source therein; and retaining means coupled to the housing for retaining keys therein.

15. The key chain according to claim 14, wherein each said predetermined pattern is selectable according to a user-operable input to the controller.

16. The key chain according to claim 14, wherein the lamp controller includes a temperature sensor for selecting the at least one pattern.

17. The key chain according to claim 14, wherein each said multi-coloured lamp comprises a pair of commonly-coupled light-emitting diodes, a first light-emitting diode of the light-emitting diode comprising the first illuminating element and a second light-emitting diode of the light-emitting diode pair comprising the second illuminating element.

18. A variable-effect lighting system comprising:

a lamp assembly comprising a plurality of multi-coloured lamps in series with an AC voltage source and in series with each other, the AC voltage source having a first voltage phase and a second voltage phase opposite the first phase, each said multi-coloured lamp comprising a first illuminating element for producing a first colour of light during the first voltage phase, and a second illuminating element for producing a second colour of light different from the first colour during the second voltage phase; and a programmable lamp controller coupled to the lamp assembly for setting a conduction angle of each said illuminating element according to at least one predetermined pattern, each said predetermined pattern being stored in a memory of the controller.

19. The lighting system according to claim 18, wherein each said multi-coloured lamp comprises a pair of light-emitting diodes connected back-to-back, a first light-emitting diode of the light-emitting diode comprising the first illuminating element and a second light-emitting diode of the light-emitting diode pair comprising the second illuminating element.

20. The lighting system according to claim 18, wherein the at least one pattern is selectable according to a user-operable input to the controller.

21. The lighting system according to claim 18, wherein the lamp controller includes an ambient temperature sensor for selecting the at least one pattern.

* * * * *